US005660138A

United States Patent [19]

Hirsch

[11] Patent Number: 5,660,138

[45] Date of Patent: Aug. 26, 1997

[54] INDICATOR FOR COMPLIANCE WITH RECURRING EVENT

[76] Inventor: Victor E. Hirsch, 6573 Cathedral, Bloomfield Hills, Mich. 48301

[21] Appl. No.: 277,798

[22] Filed: Jul. 20, 1994

[51] Int. Cl.[6] ..... G09F 9/40

[52] U.S. Cl. ..... 116/308

[58] Field of Search ..... 116/306, 307, 116/308; 40/310, 311, 312, 306, 600; 206/534, 459.1; 215/365, 230, 250

[56] References Cited

U.S. PATENT DOCUMENTS

| | | | |
|---|---|---|---|
| 579,474 | 3/1897 | Barry | 116/308 |
| 1,057,296 | 3/1913 | Takenaga | 40/310 |
| 2,461,968 | 2/1949 | Derham | 215/365 X |
| 2,770,209 | 11/1956 | Niclaus | 40/310 |
| 2,791,846 | 5/1957 | Muelberger, Jr. | 40/311 |
| 2,814,267 | 11/1957 | Goldstein et al. | 215/365 X |
| 2,833,064 | 5/1958 | Parker | 40/312 |
| 2,861,538 | 11/1958 | Evans . | |
| 3,034,639 | 5/1962 | Fuerste . | |
| 3,256,978 | 6/1966 | Srigley et al. | 40/310 X |
| 3,288,277 | 11/1966 | Hallerbach . | |
| 3,437,236 | 4/1969 | Huck . | |
| 3,450,252 | 6/1969 | Hallerbach . | |
| 3,483,845 | 12/1969 | Hartman, Jr. . | |
| 3,533,371 | 10/1970 | Gronemeyer et al. . | |
| 4,448,310 | 5/1984 | Hodgson | 206/526 |
| 4,838,453 | 6/1989 | Luckstead | 221/2 |
| 4,886,010 | 12/1989 | Stutzman | 116/308 |
| 4,915,256 | 4/1990 | Tump | 221/5 |
| 5,011,032 | 4/1991 | Rollman | 215/230 |
| 5,082,113 | 1/1992 | Romik | 206/459.5 X |
| 5,188,251 | 2/1993 | Kusz | 215/220 |
| 5,261,548 | 11/1993 | Barker et al. | 215/230 |

*Primary Examiner*—Thomas B. Will
*Assistant Examiner*—Willie Morris Worth
*Attorney, Agent, or Firm*—Bliss McGlynn, P.C.

[57] ABSTRACT

An indicator for tracking compliance with the required action of a recurring event is disclosed, the indicator comprising a plurality of selectively removable tabs connected to a main body by a narrowed connecting neck, the tabs having an indicia corresponding to the specific occurrences of the recurring event. Upon compliance with the required action, the appropriately marked tab is removed by the user by breaking off the tab from the main body at the narrowed connecting neck. Appropriate indicia may be marked on the adjacent tabs of the indicator corresponding to the periodicity of the recurring event, such as twice-a-day or three times-a-day. Where the recurring event is the taking of medication, the indicator may be adapted to be attached to a standard medication bottle in a number of alternative ways. Alternatively, where the medication bottle or bottle cap are plastic, the indicator 10 may be molded directly into either of these components.

19 Claims, 1 Drawing Sheet

FIG 1
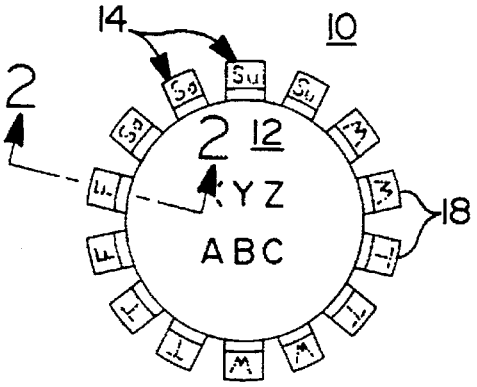
FIG 4
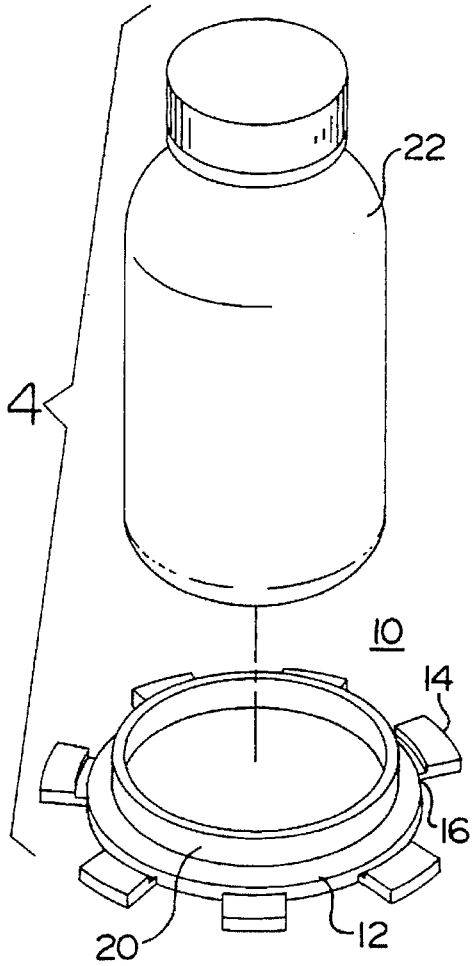
FIG 2
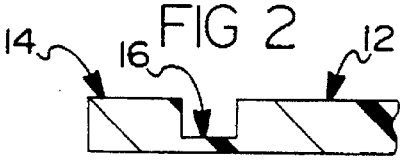
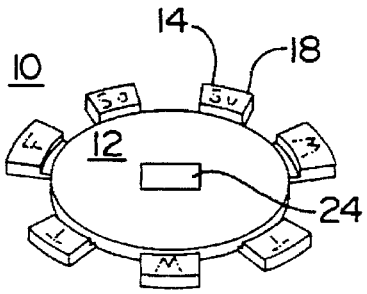
FIG 3
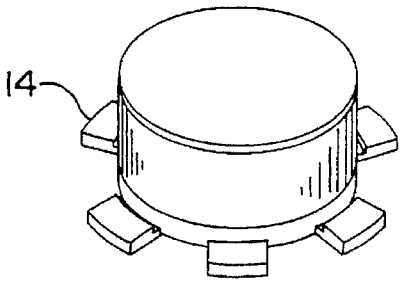
FIG 5

INDICATOR FOR COMPLIANCE WITH RECURRING EVENT

BACKGROUND OF THE INVENTION

The present invention relates to an indicator for compliance with the required action of a recurring event and more particularly to an indicator for compliance with the taking of a medication on a regular predetermined sequence.

It is easy for anyone to lose track of whether there has been compliance with a required action of a recurring event where the very repetition of that event makes it hard to keep in memory compliance with any one specific occurrence. Where that recurring event may be something as mundane as feeding the dog, the routine and ordinary nature of the task may make the occurrence of an individual feeding so much less than memorable that some short time later, an individual can be left uncertain of whether or not the dog was fed its dinner. Where the recurring event is the taking of a medicine, the age of the patient, or the symptoms of the condition for which the medication is prescribed may increase the potential of memory loss of whether an individual dosage has or has not been taken at its scheduled time.

Moreover, where more than one individual may be responsible for the compliance with the required action of a recurring event, the potential for miscommunication increases the possibility that an individually scheduled action may be missed or may be accomplished twice. For example, a husband may not know whether his wife has already fed the dog before going off to work or a babysitter may not know if a child was given the morning dosage of a medication by the child's parent.

With regard to the problem of tracking compliance with a recurring medication such as a birth control pill, the prior art provides a number of dispensing containers. As shown in U.S. Pat. Nos. 3,288,277 and 3,450,252, both to Hallerbach, these dispensers typically provide a plurality of pill holding units, each of which may be marked with an indicia such as a day. Each unit can be selectively opened to allow access to the individual medication contained in that unit. The required formation and subsequent filling of a plurality of pill containing units requires a relatively complex structure and a relatively labor intensive effort. Other tablet dispensing devices such as U.S. Pat. No. 3,437,236 to Huck provide pill dispensers of multiple components which move relative to each other to allow access to pills in individual of a plurality of table holding units. Even more recent U.S. Pat. No. 5,261,548 to Barker et al. discloses a relatively complex structure comprising at least five separate elements which are joined to allow unidirectional relative movement. Similarly, U.S. Pat. No. 5,188,251 to Kusz also discloses a relatively complex ratcheting mechanism to provide unidirectional relative movement between components.

U.S. Pat. No. 4,838,453 discloses an even more complex pill dispenser which is provided with a built-in clock and a motor to mechanize the movement of various components of the dispenser to provide access to pockets containing the plurality of pills. Not only is such a device of relatively complex structure, but it also requires careful and extensive effort to load the appropriate combination of a plurality of pills into the appropriate pill dispensing pocket.

SUMMARY OF TEE INVENTION

The present invention provides an extremely simple indicator for compliance with the required action of a recurring event. One basis for the relative simplicity of the design is that the present invention does not attempt to simultaneously allow selective and appropriate access to medication. An additional consequence of eliminating any attempt to allow access to medication in conjunction with the indication of compliance with the recurring event is that the indicator of the present invention may be used for other purposes besides indicating compliance with a medication regime. Thus, the present invention may be used for indicating compliance with the required action of other recurring events, such as feeding of the household pets.

Thus, it is an object of the present invention to provide an indicator for compliance with the required action of a recurring event, the indicator having a design of sufficient simplicity that it can be formed as a single component and at a relatively low cost per unit.

It is another object of the present invention to provide an indicator having means to facilitate maintenance of the indicator in a convenience location relative to the required action of the recurring event.

It is a further object of the present invention to provide space for promotional text or information on the indicator such that a business entity may be thus motivated to provide the indicator as a promotional item.

With regard to the use of the indicator of the present invention as an indicator of compliance with a medication regime, it is an object of the present invention to provide indicia of the recurring event on the indicator.

It is yet a further object of the present invention to provide an indicator which may be adapted to fit a number of standard medication bottle sizes.

In order to accomplish these and other objective, the indicator of the present invention provides a main body, removable tabs connected by a narrowed neck portion to the main body, and indicia of the recurring event affixed on each of the plurality of removable tabs.

BRIEF DESCRIPTION OF THE DRAWINGS

FIG. 1 illustrates a top view of a preferred embodiment of the invention;

FIG. 2 is a cross-sectional view of Section 2—2 of FIG. 1;

FIG. 3 is a perspective view of an alternative embodiment of the present invention;

FIG. 4 is an exploded perspective view of another alternative embodiment of the invention adapted to fit to the bottom of a standard medication bottle; and FIG. 5 is a perspective view of another alternative embodiment of the present invention formed integrally with a cap for a standard medication bottle.

DETAILED DESCRIPTION OF THE PREFERRED EMBODIMENTS

As seen in FIG. 1, an indicator 10 for compliance with the required action of a recurring event is provided with a main body 12 and with a plurality of selectively removable tabs 14 generally located on the periphery of main body 12.

As seen in the cross-sectional view of FIG. 2, each of tabs 14 is connected to main body 12 by a narrowed neck portion 16. Narrowed neck portion 16 facilitates the removal of a single tab 14 from main body 12 by the user to indicate compliance with the required action of a specific one of the recurring events. Additionally, tabs 14 are provided with appropriate indicia 18 corresponding in some manner to the required action of each recurring event.

It should be readily appreciated that the particular word, letter, abbreviation, icon or symbol comprising indicia 18 is not critical so long as there is some recognizable correspondence between that particular form of indicia 18 marked on adjacent tabs 14 and the repetitive event for which compliance is being tracked. Thus, indicia 18 on each of the tabs 14 may correspond to the day on which each of the recurring event occurs and the particular form of indicia 18 may be the full name of the day, an abbreviation of the day, or merely an initial of the day on which the event occurs. Obviously, the selection of the particular indicia 18 may most often relate to the periodicity or frequency of the repetitive occurrence being tracked.

Where the recurring event occurs twice in a day, sequential adjacent tabs 14 may both be marked with the same day's initial, as seen in FIG. 1. Alternatively, individual sequential tabs may be marked with two types of indicia 18, the first being the day designator and the second being a morning or evening designator. In this example, the first tab may be marked T-m for Tuesday morning and the next tab may be marked T-e for Tuesday evening. Obviously, alternative embodiments could simple indicate Tuesday-1, Tuesday-2, Tuesday-3 on sequential adjacent tabs 14, in the case where the recurring event occurs three times a day. Where the recurring event occurs only once a day, sequential adjacent tabs 14 may be marked with sequential day designators, as shown in FIG. 3. It will be readily appreciated that other embodiments of the present invention may mark appropriate indicia 18 on three sequential adjacent tabs 14 where the recurring event occurs three times a day, may mark appropriate indicia 18 on four sequential adjacent tabs 14 where the recurring event occurs four times a day, and so on for as many reoccurrences as are necessary on a given day.

The indicator 10 may be used to facilitate tracking of a sequence of locations where medication is repetitively taken by injection, such as a daily injection of insulin taken by an individual with diabetes. In such case, the individual may be advised to rotate the location on her body where the injection is administered simply to allow body locations with prior punctures to heal. A typical sequence of locations in such case might be right arm, left leg, right buttock, left arm, right leg, and left buttock, which sequence then repeats. In such case, the sequentially adjacent tabs 14 might be marked with a sequence of indicia 18 like RA, LL, RB, LA, RL, LB, or other words, letters or symbols corresponding to the respective body locations. In use, the individual would take the injection and remove the tab 14 corresponding to the body location of that injection. For the next dosage, the indicator 10 indicates the next location in the appropriate sequence. After that dosage, the corresponding tab 14 is removed and the sequence continues.

To facilitate the ease and accuracy of correct identification of an indicator 10 bearing appropriate indicia 18 for the periodicity or frequency of the recurring event, indicators 10 with once-a-day indicia 18 may be color coded with a different color than an indicator 10 with twice-a-day indicia 18. Thus, an indicator 10 with once-a-day indicia 18, as shown in FIG. 3, may be color coded blue, while an indicator 10 with twice-a-day indicia 18, as shown in FIG. 1, may be color coded red, and a three-times-a-day indicia 18 may be color coded yellow. Obviously, this color coding may extend to however many occurrences per day indicia 18 must provide for specific uses of indicator 10.

Where the recurring event is taking of a medication on a twice-a-day basis, a busy pharmacist dispensing the medication may be aided by the color coding to grab a red coded indicator 10, although the careful pharmacist would also confirm that this indicator does provide two indicia 18 on sequential adjacent tabs 14 for the twice-a-day regimen.

As shown in FIGS. 4 and 5, where the recurring event is the taking of medication, the indicator 10 may be adapted to be attached to the bottle containing the medication, or to the bottle cap. Thus in FIG. 5, indicator 10 takes the form of a plurality of tabs 14 connected by neck 16 to a bottle cap which substitutes for main body 12 of the earlier embodiment. Again, indicia 18 on each of tabs 14 is appropriately selected to correspond to the number of dosages required on a daily basis.

Alternatively, as shown in FIG. 4, indicator 10 may have a main body 12 which is provided with an engaging collar 20 appropriately sized to achieve an adequate press fit with the base or bottom of a medicine bottle 22. Various sizes of indicators 10 with appropriate sized collars 20 may be provided to allow selection of an appropriately sized indicator 10 to match the individual standard bottle selected by the pharmacist from the variety of various standard bottle sizes available to contain the medication. Alternative attachment means known to the art may be substituted for engaging collar 20 to mechanically attach the indicator 10 to the bottle 22.

Alternatively, where the standard pill bottle 22 is formed of plastic, the indicator 10 may be formed unitarily with the pill bottle, such as by molding the indicator in the same molding operation which forms the bottle. In such event, it is likely that the medicine bottle 22 will substitute for main body 12, such that tabs 14 are connected by a narrowed neck portion 16 directly to bottle 22. It is to be appreciated that such a unitary formation of the indicator of the present invention with the bottle 22 is Similar to the embodiment discussed in connection with FIG. 5, the indicator 10 formed with the bottle cap. Conversely, the indicator and bottle cap combination embodiment may also be formed by methods similar to those discussed as available to the indicator and bottle combination embodiments.

Alternatively, other means known to the prior art may be used to attach an indicator 10 to a container such as medicine bottle 22. Such alternative method of attachment include, but are not limited to glue or other adhesive, which may be applied to affix the main body 12 of an indicator 10 to bottle 22, or double-sided tape to accomplish the same purpose.

In another alternative embodiment, indicator 10 may be formed of a magnetic material or provided with a magnetic element 24, as illustrated in FIG. 3, and the bottle may be provided on its bottom with an element which is magnetically receptive allow indicator 10 to be joined to bottle 22 by the magnetic attraction between the elements. Obviously, element 24 may alternatively be formed of a magnetically receptive material and the magnetic element may be affixed to the bottom of bottle 22. Of course, element 24, illustrated in FIG. 3 on the top side of main body 12, could also be provided on the bottom side of main body 12, if preferable for a specific application.

Forming the indicator 10 of the magnetic material also allows it to be attached to other metallic surfaces, such as a refrigerator, in the event that location, typically a kitchen, is more appropriate for indicator 10 given the occurrence of the recurring event. An example where such a location may be appropriate is the dispensing of a daily vitamin to a child or an adult, which typically is dispensed along with breakfast, commonly in a kitchen or breakfast area sufficiently close to the refrigerator for this to provide convenience.

As illustrated in FIG. 1, main body 12 of indicator 10 may provide space for promotional text or information. For example, where the indicator 10 is being used to track compliance with a medication dosage regime, the text may be the name, telephone number and store hours of the pharmacy. Alternatively, the promotional text may simply be a company name or trademark. It is to be appreciated that where the indicator 10 is attached to a medicine bottle 22, as shown in FIG. 4, the promotional text will be provided on the solid surface of the bottom side of main body 12 which is opposite to the side on which is provided collar 20 or alternative attachment means as discussed above.

In operation, a pharmacist filling a prescription may select an appropriate indicator 10 to be given to the user as a promotional item and may be assisted by the color coding scheme described above to select an appropriately sized indicator 10 corresponding to a twice-a-day medication regime. The pharmacist may attach the indicator 10 to the medicine bottle 22 by press fitting the medication bottle 22 into a collar 20. The user may then start the medication regime, breaking off the appropriate tab 14 which corresponds to the specific occurrence of the recurring event. Thus, if the medication is to be taken twice-a-day and is started on Tuesday evening, the second appropriate tab 14 marked with the appropriate "Tu" indicia 18 may be removed from indicator 10 by breaking off tab 14 at narrowed neck portion 16. When the following dosage is taken on Wednesday morning, the appropriate tab 14 marked with the first Wednesday indicia, "We" or the like, is removed. In the interim, the user may refer to the indicator 10 to confirm when she last took the medication. It will be appreciated from this description example that the indicator 10 of the present invention may be used in similar fashion to monitor compliance with the required action of other types of recurring events.

As many other modifications of the present invention may be understood in light of the above teachings, it should be appreciated that the invention is not to be limited by the description provided above.

I claim:

1. An indicator for compliance with a recurring event, said indicator comprising:

a unitary main body having:

a solid surface for presenting text; and a plurality of selectively removable tabs extending radially outwardly from and in a common plane with said main body, said tabs being concentrically arranged around the periphery of said main body, each of said tabs having a connecting neck portion narrowed in a direction perpendicular to the plane, and having an indicia of the periodicity of the recurrent event.

2. The indicator of claim 1 wherein said indicia of the periodicity of the recurrent event corresponds to the number of events per day.

3. The indicator of claim 1 wherein said indicia corresponds to the days of the week.

4. The indicator of claim 2 wherein said indicia further corresponds to the days of the week.

5. The indicator of claim 2 wherein said indicia further includes color-coding corresponding to the periodicities of the recurring event.

6. The indicator of claim 1 wherein the recurring event is consumption of medication.

7. A container having an indicator for compliance with a recurring event, said indicator comprising:

a unitary main body attachable to said container, said main body having a plurality of selectively removable tabs extending radially outwardly from and in a common plane with said main body, said tabs being concentrically arranged around the periphery of said container, each of said tabs having a connecting neck portion narrowed in a direction perpendicular to the plane, and having indicia of the periodicity of the recurrent event.

8. A container having an indicator for compliance with a recurring event, said indicator comprising:

a unitary main body formed unitarily with said container, said main body having a plurality of selectively removable tabs extending radially outwardly from and in a common plane with said main body, said tabs being concentrically arranged around the periphery of said container, each of said tabs having a connecting neck portion narrowed in a direction perpendicular to the plane, and having indicia of the periodicity of the recurrent event.

9. The container of claim 7 wherein said indicia of the periodicity of the recurrent event corresponds to the number of events, per day.

10. The container of claim 7 wherein said indicia corresponds to the days of the week.

11. The container of claim 8 wherein said indicia of the periodicity of the recurrent event corresponds to the number of events per day.

12. The container of claim 8 wherein said indicia corresponds to the days of the week.

13. The container of claim 7 wherein said indicator further comprises:

attachment means for attaching said indicator to said container.

14. The container of claim 13 wherein said attachment means comprises an engaging collar sized and configured so as to be adapted to be press-fit to the base of said container.

15. The container of claim 13 wherein said attachment means comprises adhesive.

16. The container of claim 13 wherein said attachment means comprises a magnetized element attached to a first one of said container and said indicator and a magnet-receptive element attached to a second one of said container and said indicator.

17. The indicator of claim 1 wherein said main body further comprises attachment means for attaching said indicator to a container.

18. The indicator of claim 17 wherein said attachment means comprises an engaging collar extending generally perpendicular to the plane and sized and configured to be press fit to a portion of the container.

19. The container of claim 14 wherein said engaging collar extends generally perpendicular to the plane.

* * * * *